US010161696B2

(12) United States Patent
Teitel

(10) Patent No.: US 10,161,696 B2
(45) Date of Patent: Dec. 25, 2018

(54) SLIDE ASSISTER SYSTEM FOR A FIREARM

(71) Applicant: Edward R. Teitel, Houston, TX (US)

(72) Inventor: Edward R. Teitel, Houston, TX (US)

( * ) Notice: Subject to any disclaimer, the term of this patent is extended or adjusted under 35 U.S.C. 154(b) by 0 days.

(21) Appl. No.: 15/588,609

(22) Filed: May 6, 2017

(65) Prior Publication Data

US 2017/0321977 A1 Nov. 9, 2017

Related U.S. Application Data

(60) Provisional application No. 62/332,506, filed on May 6, 2016.

(51) Int. Cl.
*F41A 3/72* (2006.01)
*F41C 3/00* (2006.01)

(52) U.S. Cl.
CPC . *F41A 3/72* (2013.01); *F41C 3/00* (2013.01)

(58) Field of Classification Search
CPC ..... F41A 3/72; F41C 27/00
USPC ..... 42/90, 106; 89/1.4
See application file for complete search history.

(56) References Cited

U.S. PATENT DOCUMENTS 1,278,027 A * 9/1918 Saunders ..... F41A 19/10 42/106
3,763,587 A * 10/1973 Firmalino ..... F41A 19/34 224/249
4,138,044 A * 2/1979 Musgrave ..... F41C 33/0218 224/242
4,298,150 A * 11/1981 Seldeen ..... F41C 33/0227 224/238
4,823,671 A * 4/1989 Buryta ..... F41A 3/72 42/106
6,775,940 B2 * 8/2004 Dworzan ..... F41A 9/53 42/1.01
7,543,404 B2 * 6/2009 Kovalchuk ..... F41C 33/0263 224/192
8,468,734 B2 * 6/2013 Meller ..... F41A 3/72 42/71.02
9,157,691 B2 * 10/2015 Parnell ..... F41A 3/72
9,500,439 B1 * 11/2016 Dietrich ..... F41A 3/72
2007/0138219 A1 * 6/2007 Kovalchuk ..... F41C 33/0263 224/192
2011/0088539 A1 * 4/2011 Oz ..... F41A 19/34 89/1.4
2011/0283587 A1 * 11/2011 Sharp ..... F41C 33/0281 42/90
2012/0198744 A1 * 8/2012 Meller ..... F41A 3/72 42/90
2013/0081318 A1 * 4/2013 Morando ..... F41A 35/00 42/108
2013/0111799 A1 * 5/2013 Lee ..... F41C 27/00 42/106
2013/0180152 A1 * 7/2013 Speroni ..... F41C 27/00 42/99

(Continued)

*Primary Examiner* — Joshua E Freeman
(74) *Attorney, Agent, or Firm* — Bennet K. Langlotz; Langlotz Patent & Trademark Works, Inc.

(57) ABSTRACT

A slide assist system for a firearm having a frame and a reciprocating slide is disclosed. The slide assist system contains an elongated body having a first end pivotally connected to the reciprocating slide, and an opposed free end, the elongated body being movable between a stowed position in which the elongated body extends along the reciprocating slide and a deployed position in which the free end extends away from the reciprocating slide.

17 Claims, 8 Drawing Sheets

(56) References Cited

U.S. PATENT DOCUMENTS

| | | | | |
|---|---|---|---|---|
| 2013/0255478 | A1* | 10/2013 | McAninch | F41A 7/00 89/1.4 |
| 2015/0121734 | A1* | 5/2015 | Kresser | F41A 3/72 42/16 |
| 2015/0184959 | A1* | 7/2015 | Parnell | F41A 7/00 89/1.4 |
| 2015/0233663 | A1* | 8/2015 | Kiehn | F41A 33/00 42/90 |
| 2016/0102938 | A1* | 4/2016 | Sroufe | F41A 3/72 42/16 |

* cited by examiner

SLIDE ASSISTER SYSTEM FOR A FIREARM

CROSS-REFERENCE TO RELATED APPLICATION

This application claims the benefit of U.S. Provisional Application No. 62/332,506, filed on May 6, 2016, which is incorporated herein by reference in its entirety.

FIELD OF THE INVENTION

The present invention relates to firearms. More particularly, the present invention relates to a slide assist system for a firearm.

BACKGROUND OF THE INVENTION

Referring to FIGS. 1-2, a handgun 10, as known in the art, has a breech-slide 40, having a forward end portion 42 and a rearward end portion 44. The breech-slide 40 slides rearward and forward on the upper end portion of a frame 12 of the handgun 10. The breech-slide 40, as known in the art, further has an ejector opening 45, to allow an empty cartridge to be ejected from the handgun 10. The breech-slide 40, as known in the art, further has a rear sight 55 located at the rearward end portion 44 and a front sight 60 located at the forward portion 42 for aiming.

The breech-slide 40 is used to load a new cartridge in the handgun 10's barrel for firing by gripping and pulling the breech-slide 40 towards the rearward end portion 44. The breech-slide 40 may also be used to clear a malfunction and/or to clear out an unfired cartridge to make the handgun 10 safe by gripping and pulling the breech-slide 40 towards the rearward end portion 44. Although the breech-slide 40 has striations (i.e. grooves) 50, the breech-slide 40 is difficult to operate and requires significant grip strength in user's fingers. This is even more difficult if user's fingers are not strong, are slippery, or are missing.

In view of the above, a need exists for a system to provide a user with an easier way to slide the breech-slide 40.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DESCRIPTION OF THE CURRENT EMBODIMENT

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

A slide assister system presently disclosed may allow a user to more easily slide the breech-slider 40 and may be used even if user's fingers or a hand are missing. A slide assister system presently disclosed may be stowed out of the way to allow for the handgun 10 to be holstered, to be carried in a pocket, and/or may allow shooting without interfering with the use of the sites 55 and 60 to aim.

Figure 1:
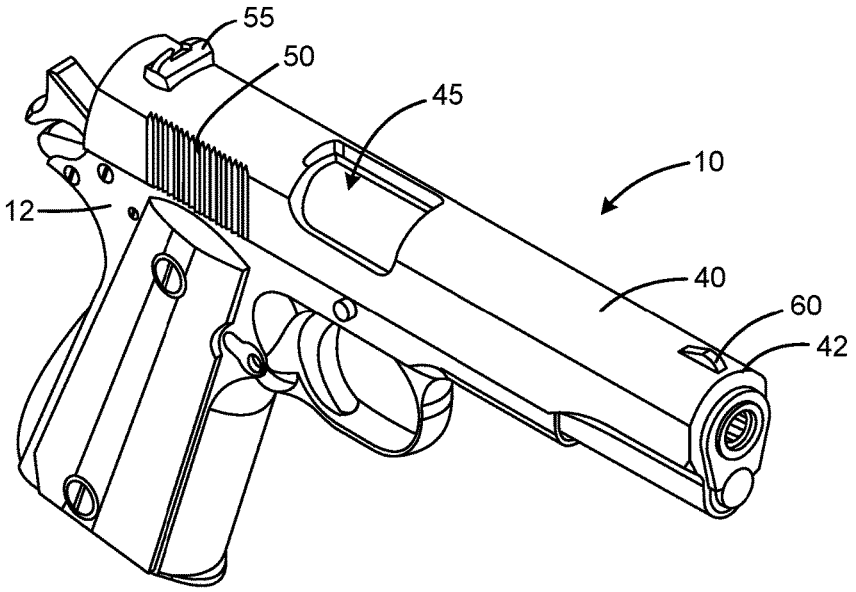
FIG. 1 PRIOR ART
FIGS. 1-2 depict a handgun as known in the art.
Figure 2:
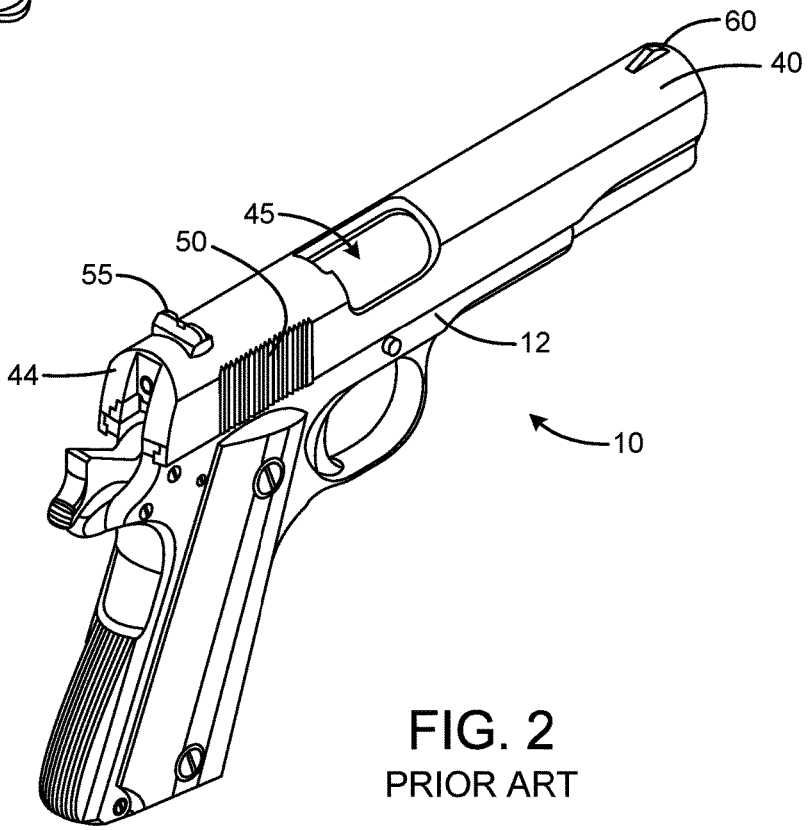
FIG. 2 PRIOR ART
Figure 3:
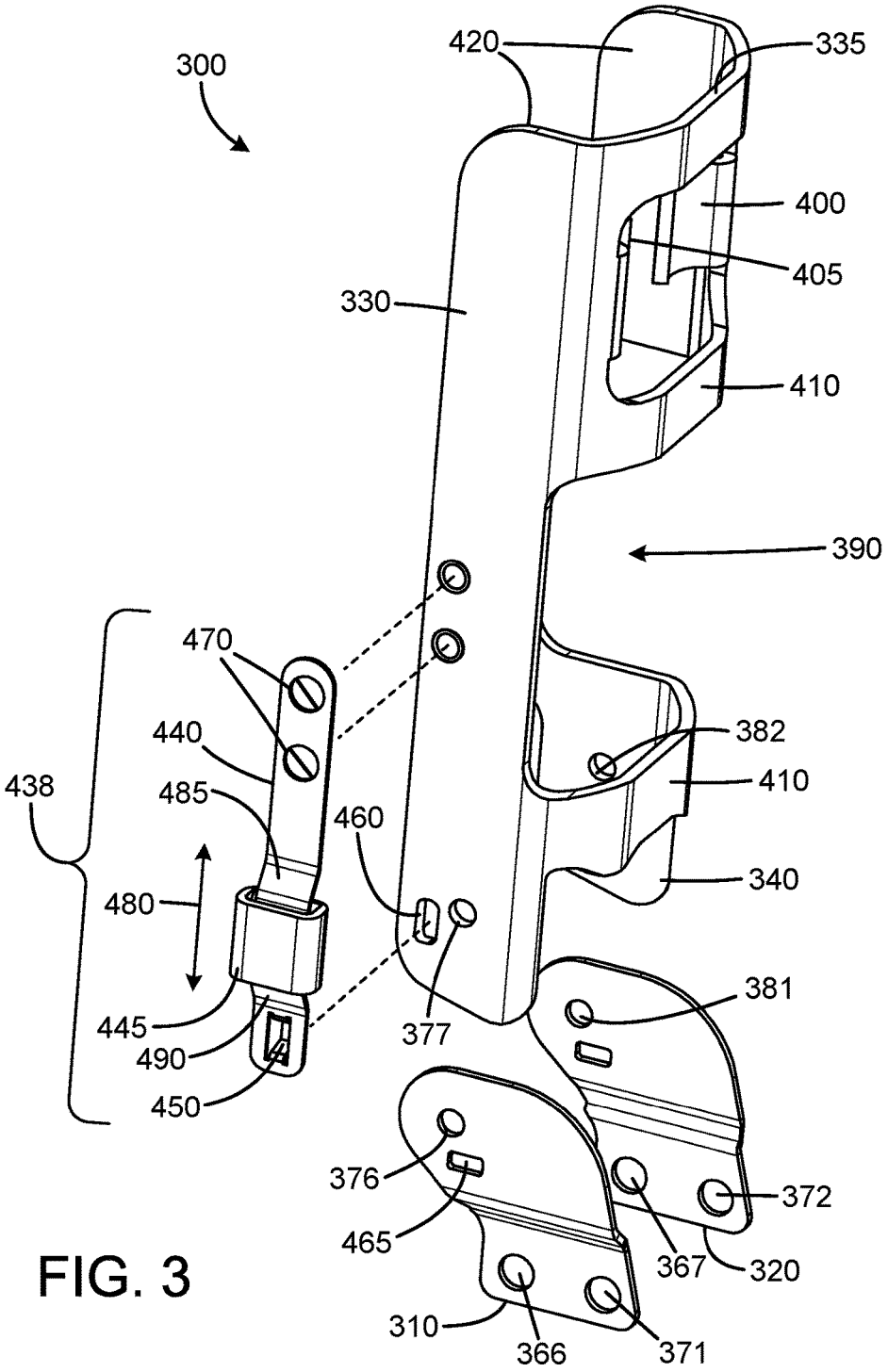
FIG. 3 depicts an exploded view of slide assister system according to the present disclosure.
Figure 4A:
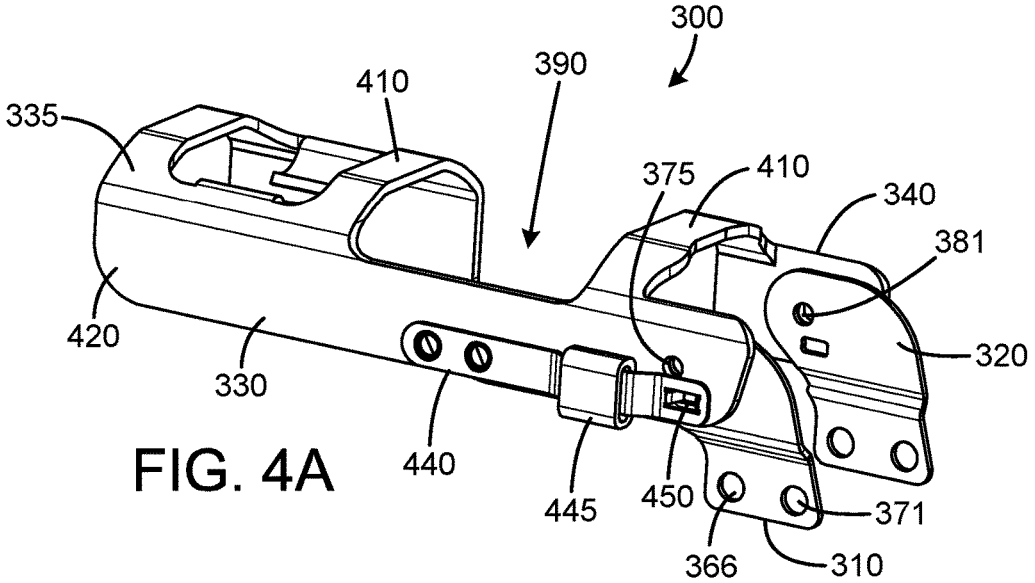
FIG. 4*a* depicts an assembled view of the slide assister system shown in FIG. 3 in a first position.
Figure 4B:
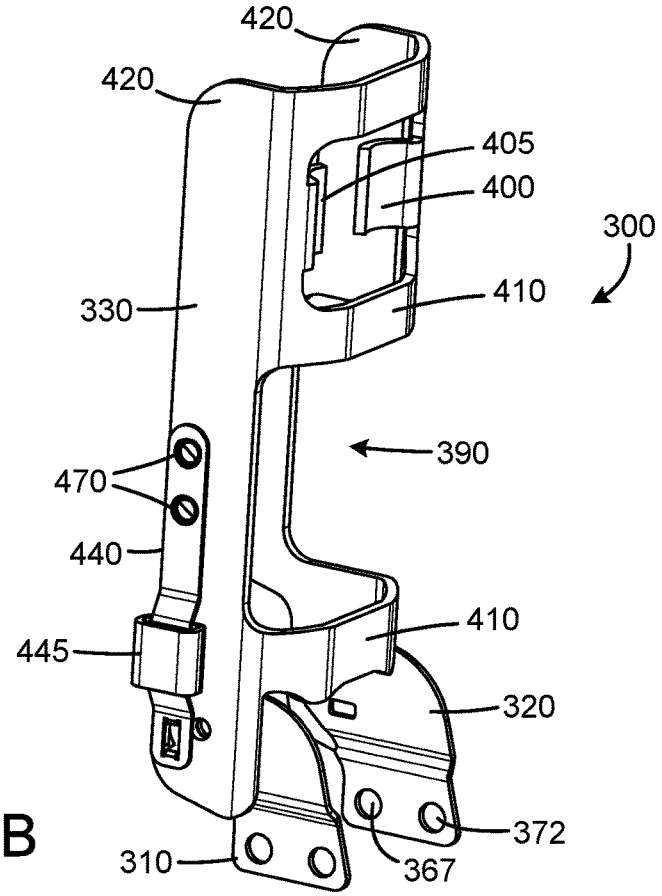
FIG. 4*b* depicts an assembled view of the slide assister system shown in FIG. 3 in a second position.

Referring to FIGS. 3 and 4*a-b*, a slide assist system 300 is shown according to the present disclosure. The slide assist system 300 may comprise a first support member 310 and a second support member 320. The slide assist system 300 may further comprise an assist handle 330. The assist handle 330 comprises a forward end portion 335 and a rearward end portion 340. The assist handle 330 may be pivotally coupled with the first and second support members 310 and 320 at the rearwards end portion 340. The forward end portion 335 of the assist handle 330 is configured to move from a first (i.e. closed or stowed) position (as shown in FIG. 4*a*) to a second (i.e. open) position (as shown in FIG. 4*b*) and back to the first position.

Figure 5:
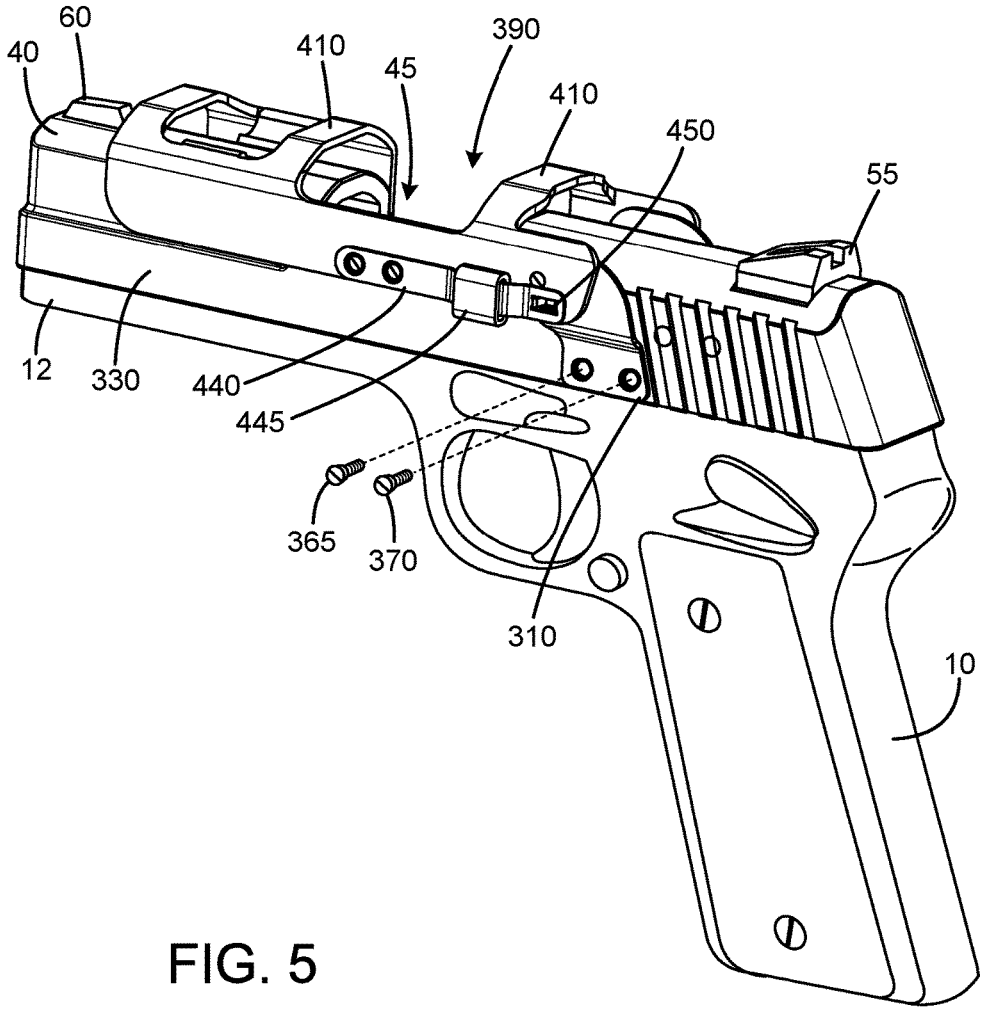
FIGS. 5-7 depict the slide assister system shown in FIG. 3 coupled with a handgun.
Figure 6:
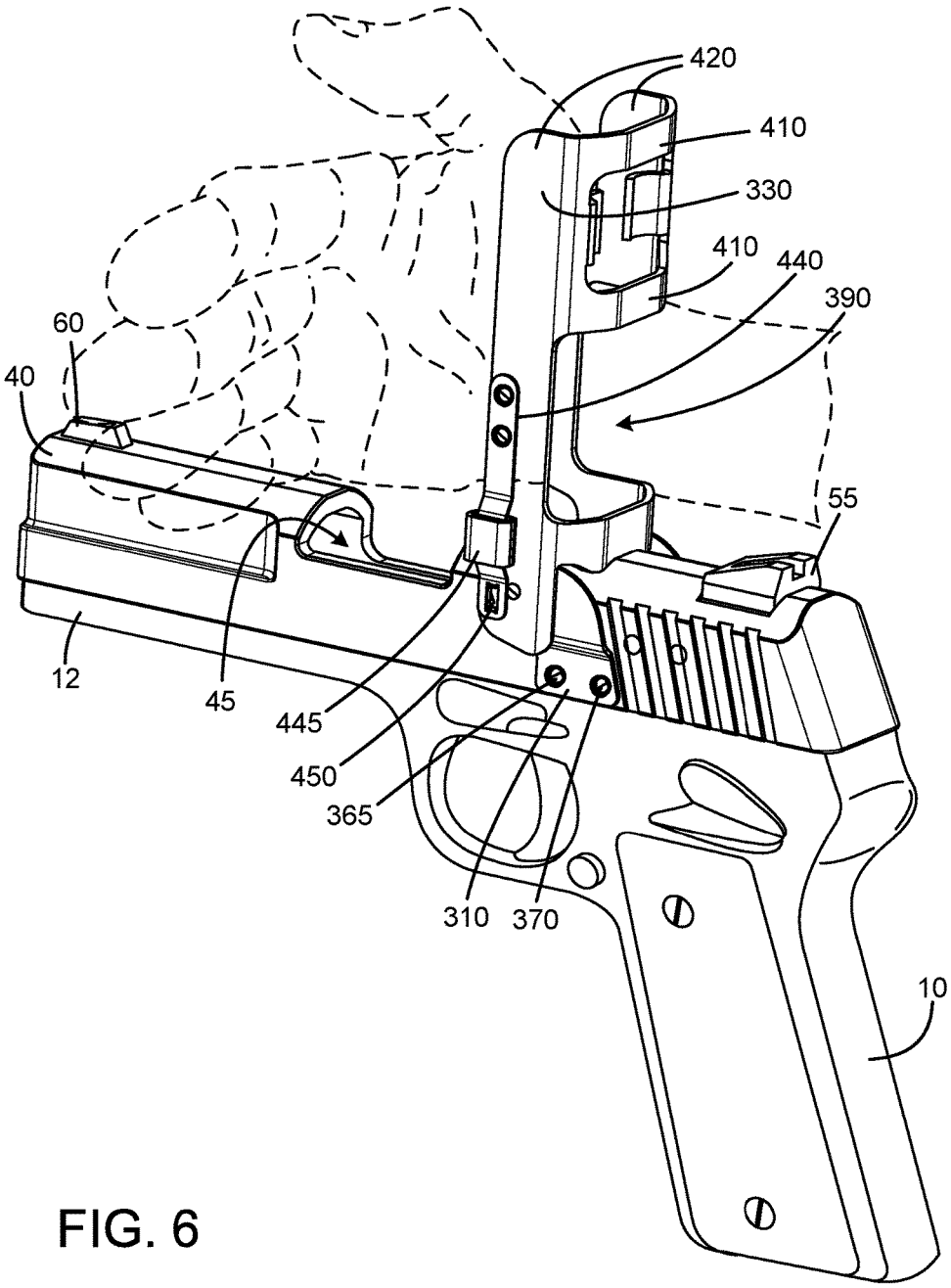

The first and second support members 310 and 320 are coupled with the breech-slider 40 as shown in FIGS. 5-6. The first support members 310 may be coupled with the breech-slider 40 using one or more threaded bolt pins 365, 370 through one or more openings 366, 371. The second support members 320 may be coupled with the breech-slider 40 using one or more threaded bolt pins (not shown) through one or more openings 367, 377.

The assist handle 330 may be pivotally coupled with the first support members 310 using pin or shoulder bolts 375 through the openings 376, 377. The assist handle 330 may be pivotally coupled with the second support members 320 using pin or shoulder bolts 380 through the openings 381, 382.

The assist handle 330 may further comprise an opening 390 configured to at least partially line up with the ejector opening 45 of the breech-slider 40 when the assist handle 330 is in the first position (as shown in FIG. 5). The opening 390 is configured to allow an empty cartridge to be ejected from the handgun 10 when the assist handle 330 is in the first position (as shown in FIG. 5). The opening 390 is positioned between the forward end portion 335 and the rearwards end portion 340.

The assist handle 330 further comprises one or more upper surfaces 410 and side walls 420. The side walls 420 may be spaced sufficiently apart to accommodate at least a portion of the breech-slider 40's width.

The assist handle 330 may further comprise a first support member 400 positioned adjacent to the forward end portion 335. The first support member 400 is configured to rest against the breech-slider 40 when the assist handle 330 is in the first position (as shown in FIG. 5). The first support member 400 is configured to prevent the assist handle 330 from moving closer to the breech-slider 40. The first support member 400 is a stopper preventing the assist handle 330 from moving closer to the breech-slider 40.

Figure 10:
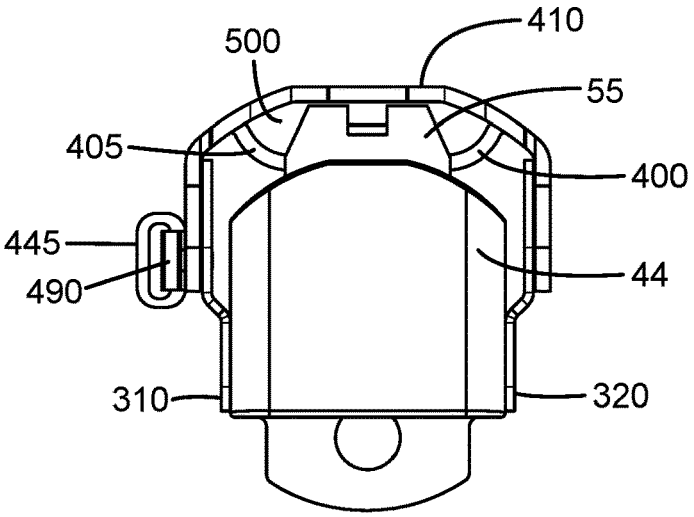
FIG. 10 depicts a rear view of the slide assister system shown in FIG. 5.

The first support member 400 is configured to position the one or more upper surfaces 410 a first distance above the breech-slider 40. The first distance may be equal or greater than to the height of the rear sight 55 and/or the front sight 60. The first support member 400 defines a sight viewing passage 500 between the one or more upper surfaces 410 and the breech-slider 40 to allow a user to aim using the rear sight 55 and the front sight 60 (shown in FIG. 10). The first support member 400 may extend from one of the side walls 420 at a first angle. The first support member 400 is positioned to allow the user to align the rear sight 55 with the front sight 60.

The assist handle 330 may also comprise a second support member 405 positioned adjacent to the forward end portion 335. The second support member 405 is also configured to rest against the breech-slider 40 when the assist handle 330 is in the first position (as shown in FIG. 5). The second support member 405 is configured to prevent the assist handle 330 from moving closer to the breech-slider 40. The second support member 405 is a stopper preventing the assist handle 330 from moving closer to the breech-slider 40.

The second support member 405 is configured to position the one or more upper surfaces 410 a second distance above the breech-slider 40. The second distance may be equal or greater than to the height of the rear sight 55 and/or the front sight 60. The first distance between the one or more upper surfaces 410 and the breech-slider 40 may be equal to the second distance between the one or more upper surfaces 410 and the breech-slider 40. The second support member 405 defines the sight viewing passage 500 between the one or more upper surfaces 410 and the breech-slider 40 to allow the user to aim using the rear sight 55 and the front sight 60 (shown in FIG. 10). The second support member 405 may extend from the other side wall 420 at a second angle. The second support member 405 is positioned to allow the user to align the rear sight 55 with the front sight 60.

Figure 9:
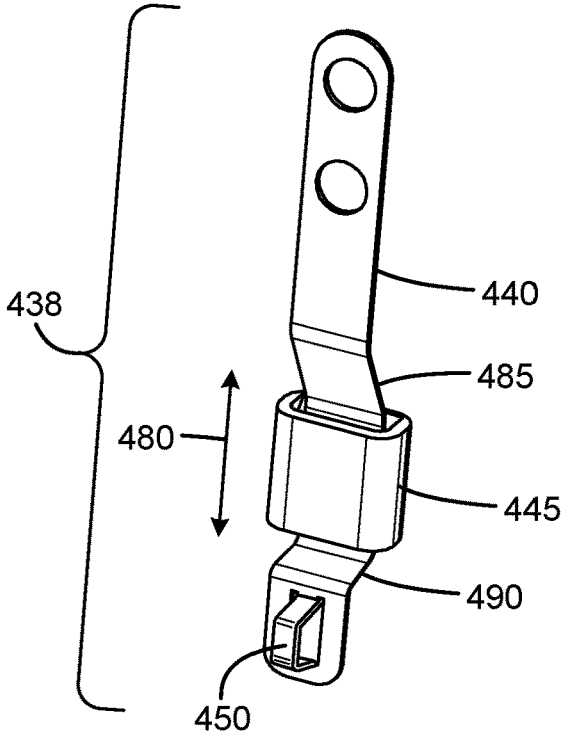
FIG. 9 depicts a latching mechanism according to the present disclosure.

Referring to FIGS. 3 and 9, the assist handle 330 may further comprise a latching mechanism 438 to prevent the assist handle 330 from unintentionally moving from the first position to the second position during operation of the handgun 10. The latching mechanism may be located adjacent to the rearwards end portion 340 of the assist handle 330. The latching mechanism may comprise a spring member 440, a sliding member 445, and a protrusion 450 as shown in FIGS. 3 and 9.

The assist handle 330 may comprise a through opening 460 (shown in FIG. 3) to accommodate the protrusion 450 (shown in FIG. 9). The first support member 310 may comprise an opening 465 (shown in FIG. 3) to accommodate the protrusion 450 when the assist handle 330 is in the first position. The opening 465 may be a through opening in the first support member 310, an indentation in the first support member 310, or a concavity in the first support member 310. When the assist handle 330 is in the first position, the protrusion 450 of the latching system locks the assist handle 330 in the first position by engaging with the opening 465 though the opening 460. When the protrusion 450 is disengaged from the opening 465, the forward end portion 335 of the assist handle 330 is free to pivotally move away from the first position towards the second position.

First end of the spring member 440 is coupled with the protrusion 450. Second end of the spring member 440 is coupled with one of the side walls 420 of the assist handle 330 using one or more rivets and/or bolts 470. The spring member 440 is tensioned to urge the protrusion 450 towards the first support member 310. The spring member 440 may comprise a first bend 485 and a second bend 490. The sliding member 445 is configured to slide along the spring member 440 as shown by arrow 480 between the first bend 485 and the second bend 490. Pushing the sliding member 445 against the first bend 485 or the second bend 490 deforms the spring member 440 and causes the protrusion 450 to disengage from the opening 465 to allow the forward end portion 335 of the assist handle 330 to freely pivot away from the first position towards the second position.

Pulling the sliding member 445 away from the assist handle 330 may also deform the spring member 440 and cause the protrusion 450 to disengage from the opening 465 to allow the forward end portion 335 of the assist handle 330 to freely pivot away from the first position towards the second position. Tension in the spring member 440 allows the protrusion 450 to engage the opening 465 when the forward end of the assist handle 330 is in the first position.

Although the latching mechanism 438 is shown coupled with the left side of the assist handle 330, it is to be understood that it can also be coupled with the right side of the assist handle 330 to prevent the assist handle 330 from unintentionally moving from the first position to the second position during operation of the handgun 10.

A portion of the upper surface 410 adjacent to the rearwards end portion 340 of the assist handle 330 is configured to abut the breech-slider 40 when the forward end portion 335 of the assist handle 330 is in the second position as shown in FIG. 6. The assist handle 330 may be substantially perpendicular to the breech-slider 40 when the forward end portion 335 of the assist handle 330 is in the second position as shown in FIG. 6. Pushing the assist handle 330 towards the rear of the handgun 10 when the forward end portion 335 of the assist handle 330 is in the second position causes the breech-slider 40 to reciprocate by moving in the same direction along the frame 12 as shown in FIG. 7.

Pushing the assist handle 330 towards the rear of the handgun 10 when the forward end portion 335 of the assist handle 330 is in the second position causes the breech-slide 40 to reciprocate by moving in the same direction along the frame 12 and to load a new cartridge in the handgun 10's barrel for firing. Pushing the assist handle 330 towards the rear of the handgun 10 when the forward end portion 335 of the assist handle 330 is in the second position causes the breech-slide 40 to reciprocate by moving in the same direction along the frame 12 and to clear a malfunction and/or to clear out an unfired cartridge to make the handgun 10 safe.

The breech-slider 40 may be any reciprocating slider, reciprocating bolt, bolt carrier, cover, or element associated with a firearm that is used to clear a malfunction and/or is used to clear out an unfired cartridge to make the handgun 10 safe and/or is used to load a new cartridge in the handgun 10's barrel for firing.

Figure 7:
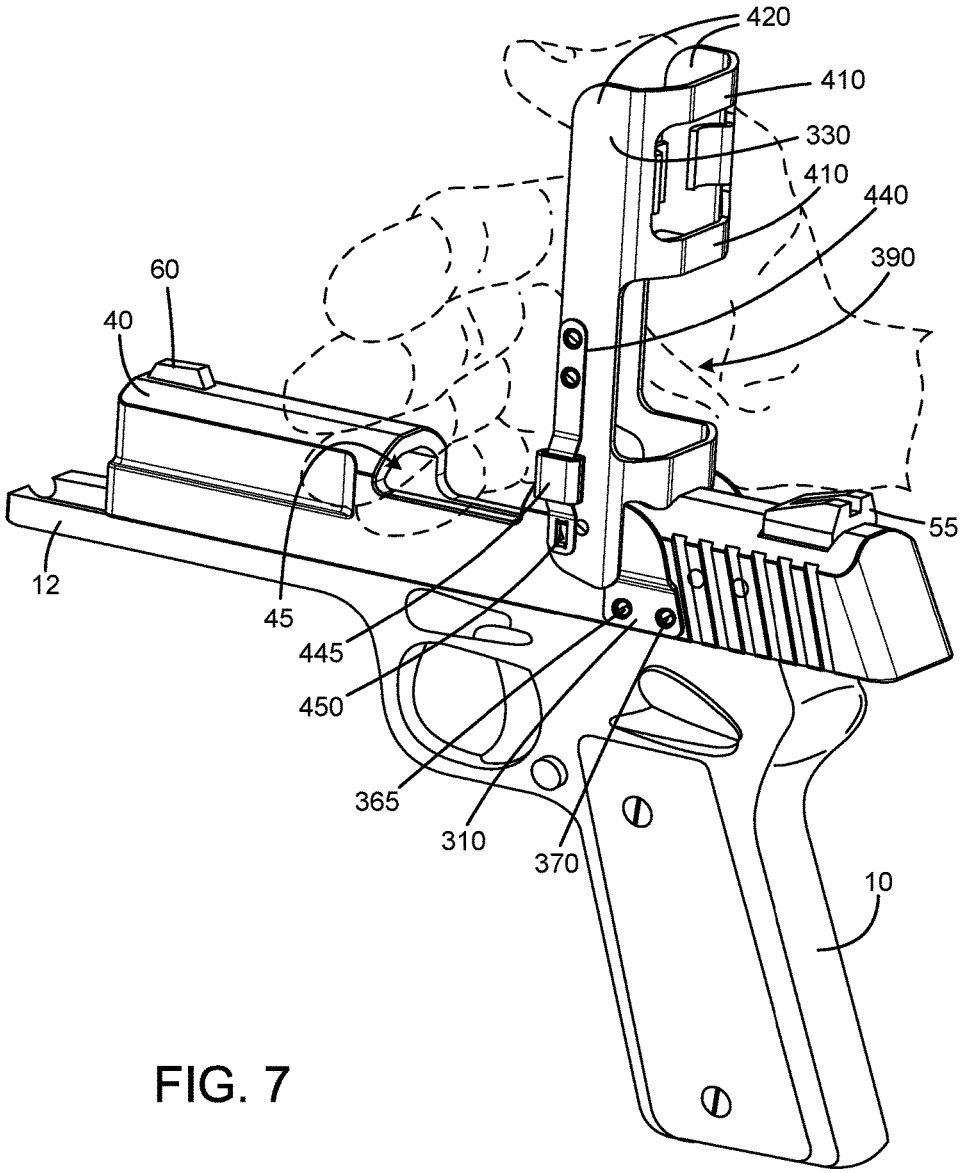
Figure 8:
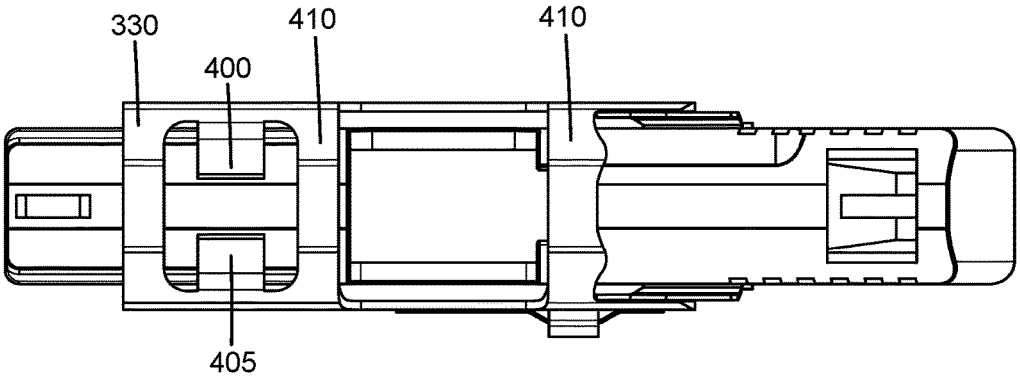
FIG. 8 depicts a top view of the slide assister system shown in FIG. 5.

The assist handle 330 may be pushed towards the rear of the handgun 10 using palm of the user's hand (as shown in FIGS. 6-7), forearm of the user's arm (not shown) or any other surface (for example, table) to causes the breech-slider 40 to reciprocate by moving in the same direction along the frame 12 as shown in FIG. 7.

During the firing of the handgun 10, the assist handle 330 is secured in the first position and the empty cartridges are ejected through the ejector opening 45 and the opening 390.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims. For instance, instead of the handle folding out vertically, it could fold out laterally, perpendicular to the plant of the pistol, or at any other angle.

We claim:

1. A slide assist system for a firearm having a frame and a reciprocating slide, the slide assist system comprising:

an elongated body having a first end pivotally connected to the reciprocating slide; and an opposed free end;

the elongated body being movable between a stowed position in which the elongated body extends along the reciprocating slide and a deployed position in which the free end extends away from the reciprocating slide; and wherein the elongated body comprises a length corresponding to a majority of a length of the reciprocating slide.

2. The slide assist system of claim 1, wherein the elongated body is perpendicular to the reciprocating slide when in the deployed position.

3. The slide assist system of claim 1, wherein the free end is forward of first end when in the stowed position.

4. The slide assist system of claim 1, wherein the elongated body comprises opposed spaced apart sidewalls adapted to closely receive a portion of the reciprocating slide when the elongated body is in the stowed position.

5. The slide assist system of claim 4, wherein the elongated body comprises an upper span portion extending between the sidewalls and spaced above the reciprocating slide when in the stowed position to define a sight viewing passage.

6. The slide assist system of claim 1, wherein the elongated body defines a U-shaped channel.

7. The slide assist system of claim 1, wherein the elongated body defines a horizontal pivot axis.

8. The slide assist system of claim 1, wherein the elongated body is connected to pivot connections at opposed sides of the reciprocating slide.

9. A slide assist system for a firearm having a frame and a reciprocating slide, the slide assist system comprising:

an elongated body having a first end pivotally connected to the reciprocating slide; and an opposed free end;

the elongated body being movable between a stowed position in which the elongated body extends along the reciprocating slide and a deployed position in which the free end extends away from the reciprocating slide; and wherein the elongated body defines an aperture at an intermediate location between the first end and the free end and adapted to register with an ejection port on the reciprocating slide when in the stowed position.

10. A slide assist system for a firearm having a frame and a reciprocating slide, the slide assist system comprising:

an elongated body having a first end pivotally connected to the reciprocating slide; and an opposed free end;

the elongated body being movable between a stowed position in which the elongated body extends along the reciprocating slide and a deployed position in which the free end extends away from the reciprocating slide; and wherein the free end is proximate a forward end of the reciprocating slide when in the stowed position.

11. A slide assist system comprising:

a first support member coupled with a first side of a breech-slider of a handgun;

a second support member coupled with a second side of the breech-slider; and an elongated assist handle comprising a forward end portion and a rearward end portion;

wherein the elongated assist handle is pivotally coupled with the first support member and the second support member at the rearwards end portion;

wherein the forward end is configured to move from a first position to a second position;

such that reciprocation of the breech-slider is facilitated by pushing the elongated assist handle towards the rear of the handgun when the elongated assist handle is in the second position; and a latching mechanism for preventing the forward end from moving towards the second position.

12. The slide assist system of claim 11, wherein the assist handle is perpendicular to the breech-slider when the forward end is in the second position.

13. The slide assist system of claim 11, wherein the assist handle comprises opposed spaced apart sidewalls adapted to closely receive a portion of the breech-slider when the forward end is in the first position.

14. The slide assist system of claim 13, wherein the assist handle comprises an upper span portion extending between the sidewalls and spaced above the breech-slider when the forward end is in the first position to define a sight viewing passage.

15. The slide assist system of claim 11, wherein the assist handle defines a U-shaped channel.

16. A slide assist system comprising:

a first support member coupled with a first side of a breech-slider of a handgun;

a second support member coupled with a second side of the breech-slider; and an elongated assist handle comprising a forward end portion and a rearward end portion;

wherein the elongated assist handle is pivotally coupled with the first support member and the second support member at the rearwards end portion;

wherein the forward end is configured to move from a first position to a second position;

such that reciprocation of the breech-slider is facilitated by pushing the elongated assist handle towards the rear of the handgun when the elongated assist handle is in the second position; and wherein the assist handle defines an aperture at an intermediate location between the forward end and the rear end and adapted to register with an ejection port on the breech-slider when the forward end is in the first position.

17. A slide assist system for a firearm having a frame and a reciprocating slide, the slide assist system comprising:

an elongated body handle having a first end pivotally connected to the reciprocating slide; and an opposed free end;

the elongated body handle being movable between a stowed position in which the elongated body handle extends along a top surface of the reciprocating slide and a deployed position in which the free end extends away from the top surface of the reciprocating slide; and the elongated body handle having a stop element adapted to contact a portion of the slide to prevent the elongated body handle from being moved rearward of the deployed position.

* * * * *